US007143536B2

(12) United States Patent
Moosheimer et al.

(10) Patent No.: US 7,143,536 B2
(45) Date of Patent: Dec. 5, 2006

(54) LABEL WITH SPECIAL FIXING

(75) Inventors: Ulrich Moosheimer, Hohenkammer (DE); Robert Unglert, München (DE)

(73) Assignee: Schreiner Group GmbH & Co. KG, Oberschleissheim (DE)

( * ) Notice: Subject to any disclaimer, the term of this patent is extended or adjusted under 35 U.S.C. 154(b) by 0 days.

(21) Appl. No.: 10/912,680

(22) Filed: Aug. 5, 2004

(65) Prior Publication Data

US 2005/0223609 A1 Oct. 13, 2005

(30) Foreign Application Priority Data

Aug. 14, 2003 (EP) ..... 03018472

(51) Int. Cl.
*G09F 3/10* (2006.01)

(52) U.S. Cl. ..... 40/638; 40/594; 40/674; 40/675

(58) Field of Classification Search ..... 40/310, 40/638, 594, 674, 675; 283/81; 215/399; 428/42.2, 42.34
See application file for complete search history.

(56) References Cited

U.S. PATENT DOCUMENTS 5,135,125 A 8/1992 Andel et al.
5,490,658 A * 2/1996 Coward et al. ..... 248/683
6,349,974 B1 * 2/2002 Grosskopf et al. ..... 283/81
6,457,747 B1 10/2002 Treleaven et al.

FOREIGN PATENT DOCUMENTS

| | | |
|---|---|---|
| DE | 39 07 862 | 9/1990 |
| DE | 195 34 642 | 3/1997 |
| EP | 0 386 753 | 9/1990 |

* cited by examiner

*Primary Examiner*—Lesley D. Morris
(74) *Attorney, Agent, or Firm*—Collard & Roe, P.C.

(57) ABSTRACT

A label has a film and an adhesive, as with a common bracket label. The label is divided into two functional regions (A) and (B) by a separating line. One region essentially supplies information, for example, by imprinting, and the other region assumes the hanging function of the bracket. Region (B) is generally designed to be non-adhering or is capable of reducing the adhesive action. In this manner, the bracket can be detached quickly from the labeled object with use, and no adhesive region is bared upon detachment. A lower film lies under the first film and is preferably connected with the first film by an adhesive. The lower film is provided with a further separating line slightly offset to the separating line between the two functional regions.

8 Claims, 2 Drawing Sheets

LABEL WITH SPECIAL FIXING

BACKGROUND OF THE INVENTION

1. Field of the Invention

The invention relates to a label with slotting or stamping in the material. Specifically, the invention relates to the area of bracket labels.

2. The Prior Art

Bracket labels have been known for some time in patent literature. In addition to the designation of objects, they enable the hanging of the labeled objects. Accordingly, they are subdivided principally into two functional areas: a possible large surface part fixedly adhered to a container serves for supplying information; a second part is moved away from the labeled container with use of the bracket label and used as a hanging device.

Basically, one- and multi-layer bracket labels differ. With the one-layer labels, such as those described in DE 3907862 C2, a through-going slotting or stamping is provided in a self-adhesive coated film, by means of which both functional areas are separated from one another.

These types of labels are simple and can be manufactured cost-effectively. The disadvantage of these products according to the state of the art, however, is that the hanging area relative to the information area is freely moveable based on the through-going slotting or stamping. This can lead to warping upon dispensing of an object. In particular, this is true for curved objects, such as bottles, special infusion bottles, for the bracket labels used in the first line. The larger the label is, the greater the warping that occurs. The high dispensing speed of modern label assemblies increases this problem still more noticeably.

SUMMARY OF THE INVENTION

It is therefore an object of the invention to make a slotted or stamped label, with which the danger of warping upon dispensing is greatly reduced. First, a safe dispensing of larger labels is made possible and second, an increase of dispensing speed is made possible.

This object is accomplished by a non-permanent adhesion of a partial area of the adherable label area (the hanging area) with the area, which is adhered fixedly on the object.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
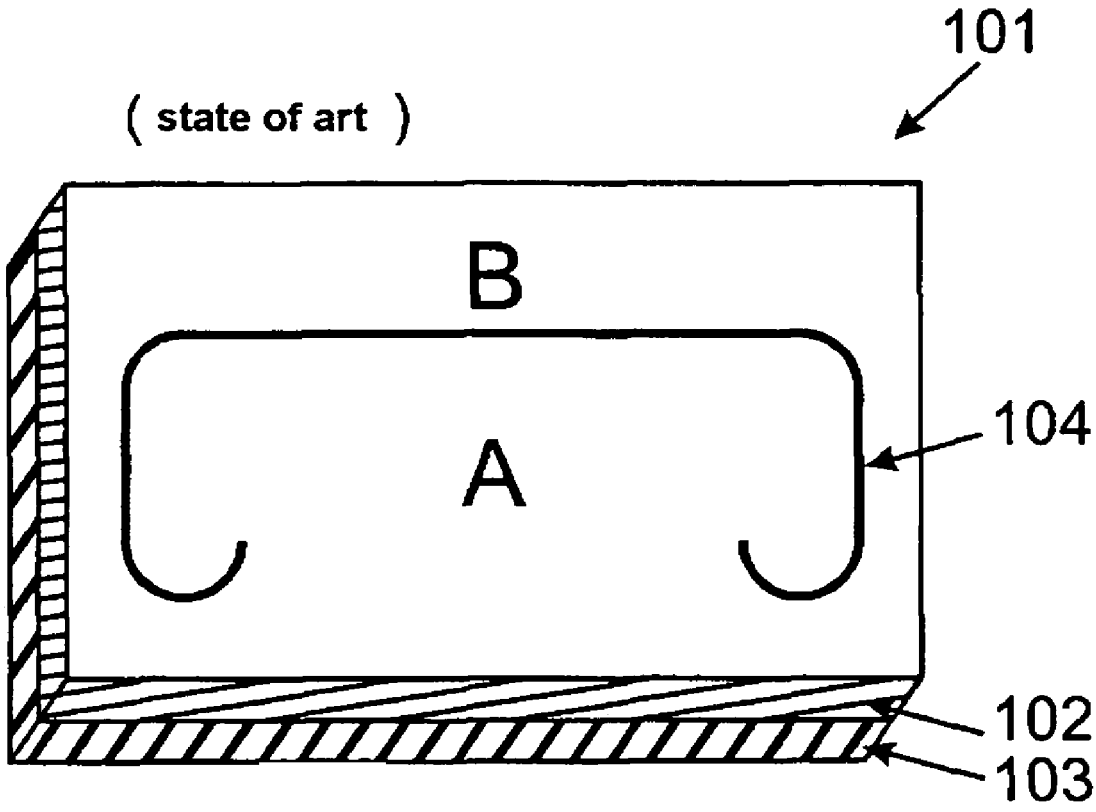
FIG. 1 shows a perspective view fo a one layer bracket label according to the state of the art.

Referring now to the drawings, FIG. 1 shows a one-layer bracket label 101 according to the state of the art. It comprises in layer structure principally at least one film 102 and one adhesive 103. By a separation line 104, it is divided into two functional regions A and B, whereby A serves essentially for the supply of information, for example, by printing, and B assumes the hanging function of the bracket. As previously set forth, with this product, the danger of warping with dispensing exists: the region B is generally neither designed to be adhesive nor provided with means for avoiding or minimizing an adhesive action. In this manner, the bracket can be taken with use quickly from the labeled object, and no adhesive area is revealed upon pulling off. This is of great importance in pharmaceutical applications, for example, in sterile environments. By means of the nonexistent connection along separating line 104 between region A and region B, the region B can be removed easily from region A upon dispensing of the label 101, so that a gap exists between A and B and stresses occur, which lead to the warping of the entire label. Such labels must be separated out and removed after dispensing, above all in the highly sensible pharmaceutical areas of application. In this regard, high costs for the method, quality control, and the material exist.

Figure 2:
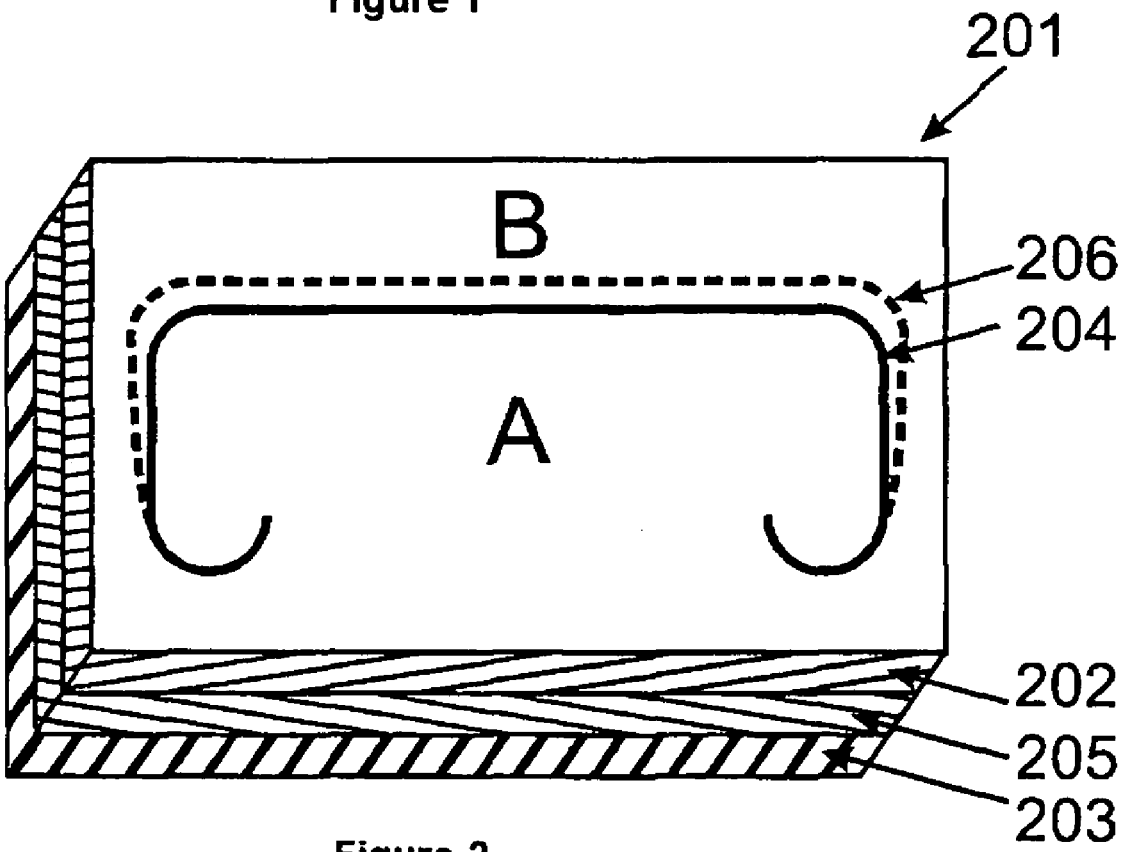
FIG. 2 shows a perspective view of one embodiment of the invention.

FIG. 2 shows a preferred embodiment of a label structure 201 according to the present invention in analogy to FIG. 1. In addition to film 202, adhesive 203, and separating line 204, two essentially further features are included: a film 205 now lies under film 202, preferably connected by an adhesive with 202. Slightly offset to separating line 204, lower film 205 is provided with a further separating line 206.

Figure 3:
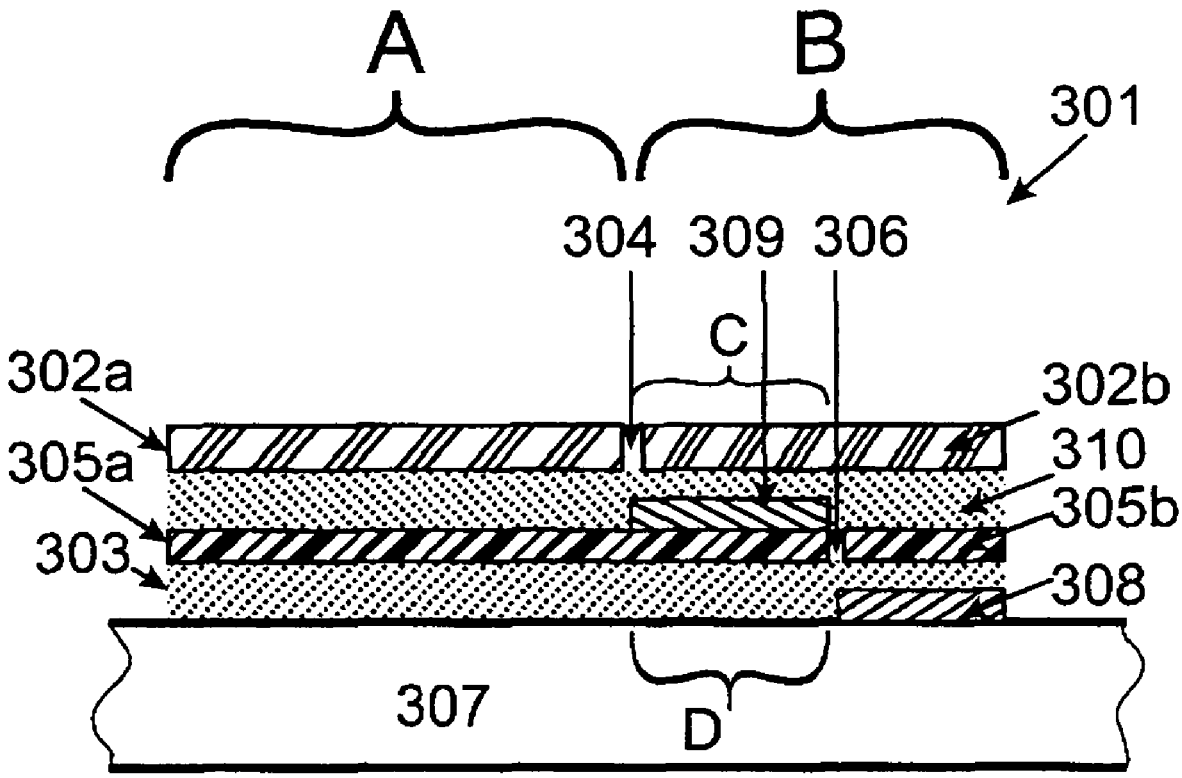
FIG. 3 shows a schematic side view of the label of FIG. 2.

FIG. 3 shows the same label structure in a schematic side view. A label 301 is adhered by means of adhesive layer 303 to an object 307. Two film layers 302 and 305 are connected to one another by means of a further adhesive layer 310. Both film layers are divided themselves by separating lines 304 and 306 into sections 302*a* and *b* and 305*a* and *b*. Separating lines 304 and 306 lie offset horizontally to one another; they are generally pressed out differently at least in partial regions. In addition, under adhesive layer 303 in the region of film section 305*b*, a means for avoidance or reducing the adhesive effect 308 is applied. Alternatively, it is also possible to apply the adhesive layer 303 only in the area of section 305*a*. On the other side of film layer 305 in the region of 305*a* between separating lines 305 and 306, a so-called release layer 309 also is applied. In this regard, it acts as a means, with which the adhesion of adhesive 310 can be accurately placed in this region, as is popular, as a silicon layer.

The shown label is analogous to FIGS. 1 and 2 in being divided into two regions A and B, whereby B forms the removable bracket.

The effect of this label structure 201/301 of the present invention is that the region B based on the two layers 308 and 309 remains removable and therewith, can serve as a detachable bracket; however, it is connected in its partial region C with the partial region D of region A. Particularly advantageous is a product of the present invention, then, when the separating line 304 lies closer to the center of the label than the separating line 306. Therewith, the detachment of region B is essentially facilitated for the user. In the sense of a still greater fixing of region B, however, the separating lines can also be arranged the other away around. During dispensing, in each case, removal of both regions A and B from one another and the formation of stresses connected therewith and lastly, warping, are practically impossible.

The same is true in principle not only for the forms of bracket labels shown here, and in addition, is true not only for bracket labels. Similar warping can always occur, then, when a label is subdivided by separating lines into two different regions, which are not completely separated from one another.

Accordingly, while only a few embodiments of the present invention have been shown and described, it is obvious that many changes and modifications may be made thereunto without departing from the spirit and scope of the invention.

What is claimed is:

1. A label comprising an upper film layer and a lower film layer, each extending coherently into a detachable first region and a second region of said label, wherein a portion of the first region is fixed adhesively and non-permanently, to a portion of the second region;

wherein the first region and the second region are defined by separating lines in the upper film layer and the lower film layer; with a first separating line in the upper film layer; and with a second separating line in the lower film layer;

said first and said second separating lines are offset horizontally to one another; and said first separating line in the upper film layer lies closer to center of the label than said second separating line in the lower layer.

2. A label according to claim 1, wherein the second region is provided, on a bottom side thereof, with an adhesive.

3. A label according to claim 1, wherein the first region forms a hanging bracket.

4. A label according to claim 1, wherein the portion of the first region adhered to the second region is part of the upper film layer and the portion of the second region on which the adhered portion of the first region is adhered, is part of the lower film layer.

5. A label according to claim 1, in which the first region and the second region are defined by stamping lines, cutting lines, or slotted lines in the upper film layer and the lower film layer.

6. A label according to claim 1, wherein the non-permanently adhered portion of the first region has means for reducing adhesive force.

7. A label according to claim 1, wherein there is an adhesive layer between said upper film layer and said lower film layer connecting together these film layers; and wherein there is a release layer between said separating lines and between said film layers within said adhesive layer.

8. A label according to claim 7, wherein there is another adhesive layer beneath and in contact with said lower film layer; and wherein there is another release layer between said second separating line in the lower film layer and an end of said first region within said another adhesive layer.

* * * * *